US005320336A

United States Patent [19]

Asami

[11] Patent Number: 5,320,336

[45] Date of Patent: Jun. 14, 1994

[54] SHEET STACKING DEVICE WITH VERTICALLY MOVABLE TRAY

[75] Inventor: Shinji Asami, Hanazono, Japan

[73] Assignee: Ricoh Company, Ltd., Tokyo, Japan

[21] Appl. No.: 41,415

[22] Filed: Mar. 31, 1993

[30] Foreign Application Priority Data

Apr. 1, 1992 [JP] Japan ..... 4-079818

[51] Int. Cl.[5] ..... B65H 39/02; B42B 2/00

[52] U.S. Cl. ..... 270/58; 270/53

[58] Field of Search ..... 270/53, 58; 355/322, 355/324

[56] References Cited

U.S. PATENT DOCUMENTS 4,993,697 2/1991 Yamashita et al. ..... 270/58 X
4,994,865 2/1991 Nishimori et al. ..... 355/324
5,026,034 6/1991 Russel et al. ..... 270/58 X
5,098,074 3/1992 Mandel et al. ..... 270/53
5,263,697 11/1993 Yamazaki et al. ..... 270/53

*Primary Examiner*—Edward K. Look
*Assistant Examiner*—John Ryznic
*Attorney, Agent, or Firm*—Oblon, Spivak, McClelland, Maier & Neustadt

[57] ABSTRACT

A device for stacking sheets sequentially driven out of an image forming apparatus on a tray. The device is capable of stacking both of stapled sheets and non-stapled sheets accurately without damaging them. In a stapling mode, the tray is positioned at a home position in which the top surface of the tray or the top-most sheet in the tray is spaced apart from a positioning roller a distance greater than a thickness of a maximum number of sheets which can be stapled together.

3 Claims, 8 Drawing Sheets

SHEET STACKING DEVICE WITH VERTICALLY MOVABLE TRAY

BACKGROUND OF THE INVENTION

The present invention relates to a device for stacking sheets sequentially coming out of an image forming apparatus on a tray.

A copier, printer or similar image forming apparatus has a tray for accommodating sheets each carrying an image thereon. For example, Japanese Patent Laid-Open Publication No. 233458/1990 proposes an image forming apparatus having a tray capable of stacking both of stapled sheets and non-stapled sheets, as needed. In this construction, non-stapled sheets are driven out one after another by a discharge roller and let fall onto the tray simply by gravity. This brings about a problem that the sheets cannot be neatly stacked on the tray, preventing, for example, different jobs from being clearly distinguished when a shifting operation is effected.

Although some implementations have been proposed to eliminate the above problem, none of them is fully satisfactory.

SUMMARY OF THE INVENTION

It is, therefor, an object of the present invention to provide a sheet stacking device for an image forming apparatus which is capable of stacking both of stapled sheets and non-stapled sheets accurately without damaging them.

A sheet stacking device for an image forming apparatus of the present invention comprises a discharge roller for discharging a sheet driven out of the image forming apparatus, a tray for stacking the sheets sequentially discharged by the discharge roller, a rotatable positioning roller facing the top of the sheets stacked on the tray, a sensor for sensing a level of uppermost one of the sheets stacked on the tray, a tray moving mechanism for adjusting the level of the uppermost one of the sheets in response to an output of the sensor, and a controller for locating, when non-stapled sheets are discharged one by one, the tray at a home position where the tray contacts the positioning roller or locating, when stapled sheets are discharged, the tray at a home position where the tray is spaced apart from the positioning roller.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 10:
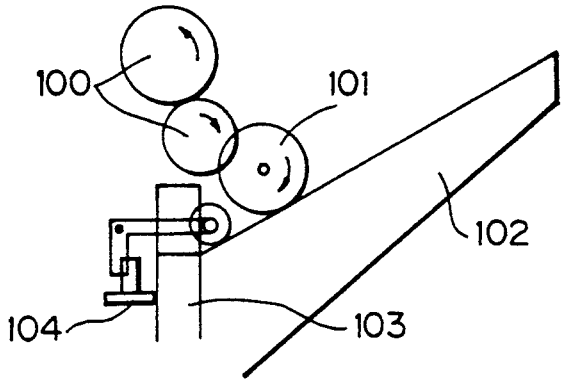
Fig. 10 PRIOR ART
FIG. 10 is a section showing a conventional sheet stacking device.

To better understand the present invention, a brief reference will be made to a conventional sheet stacking device for an image forming apparatus, shown in FIG. 10. The sheet stacking device shown in FIG. 10 is one of the implementations elaborated to eliminate the problem discussed earlier in relation to Japanese Patent Laid-Open Publication No. 233458/1990, i.e., to cope with the irregular stacking of sheets. As shown, the device has a discharge roller pair 100, a positioning roller 101 located immediately below and facing the discharge roller pair 100, and a tray 102. As the discharge roller pair 100 discharges a sheet, the positioning roller 101 draws it toward an end fence 103 while urging it against the tray 102. As a result, the sheet is positioned on the tray 102 in abutment against the end fence 103. The reference numeral 104 designates a sensor responsive to the home position of the tray 102.

Figure 11:
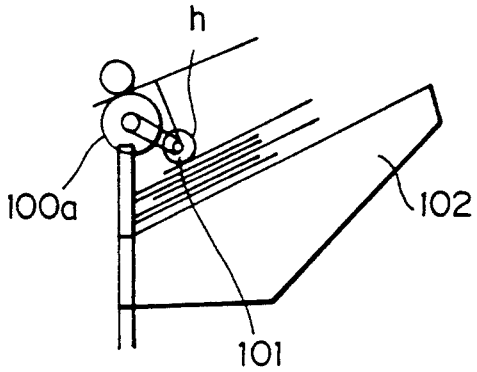
Fig. 11 PRIOR ART
FIGS. 11 and 12 are sections indicative of drawbacks particular to the conventional sheet stacking device.
Figure 12:
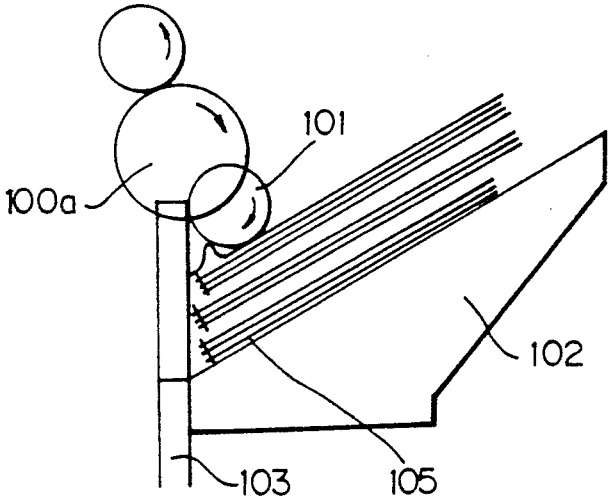
Fig. 12 PRIOR ART

As shown in FIG. 11, the periphery of the positioning roller 101 protrudes from a line tangential to the periphery of one discharge roller 100*a* and perpendicular to an intended direction of sheet discharge, as indicated by h in the figure. This is undesirable since the sheet contacts the upper portion of the positioning roller 101 at the trailing edge thereof and is, therefore, subjected to a force tending to drive it in a direction opposite to the drawing direction. As a result, some sheets protrude from the stack, as also shown in FIG. 11. Moreover, as shown in FIG. 12, when stapled sheets are sequentially stacked on the tray 102, the positioning roller 101 causes the surface of the uppermost stapled stack to rise due to the drawing force thereof. Then, it is likely that the sheets of the uppermost stack are ripped off at a stapled portion 105 or otherwise damaged.

Figure 1:
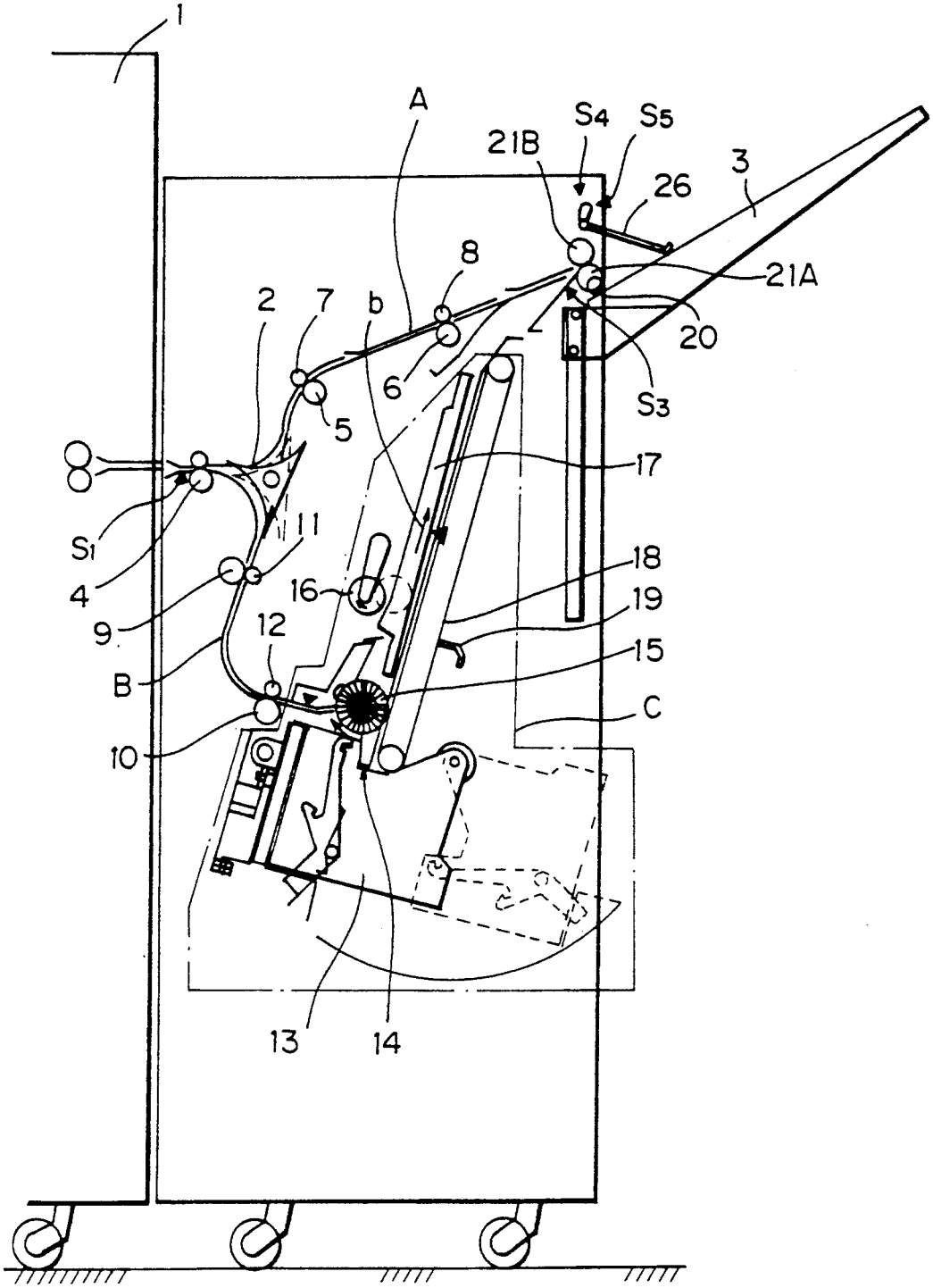
FIG. 1 is a section of a finisher including a sheet stacking device embodying the present invention.

Referring to FIG. 1, a finisher implemented with a sheet stacking device embodying the present invention is shown and mounted on the side of an image forming apparatus 1. As shown, the finisher 1 has two different transport paths therein, i.e., a path A for transporting a sheet driven out of the apparatus 1 directly to a tray 3 via a pawl or path selector 2, and a path B for transporting the sheet to a staple unit C. Both of the paths A and B terminate at the tray 3 capable of stacking both of stapled and non-stapled sheets, as desired. A transport roller 4 receives a sheet coming out of the apparatus 1. An inlet sensor S1 is located to precede the transport roller 4 for sensing the leading edge and trailing edge of a sheet being transported.

A plurality of transport rollers 5 and 6 are positioned on the path A while driven rollers 7 and 8 are associated with the rollers 5 and 6, respectively. The rollers 5, 6, 7 and 8 coact to convey a sheet driven out of the apparatus 1 directly to the tray 3. Likewise, a plurality of transport rollers 9 and 10 and associated driven rollers 9 and 10 are arranged on the path B for driving a sheet to the staple unit C.

Figure 2:
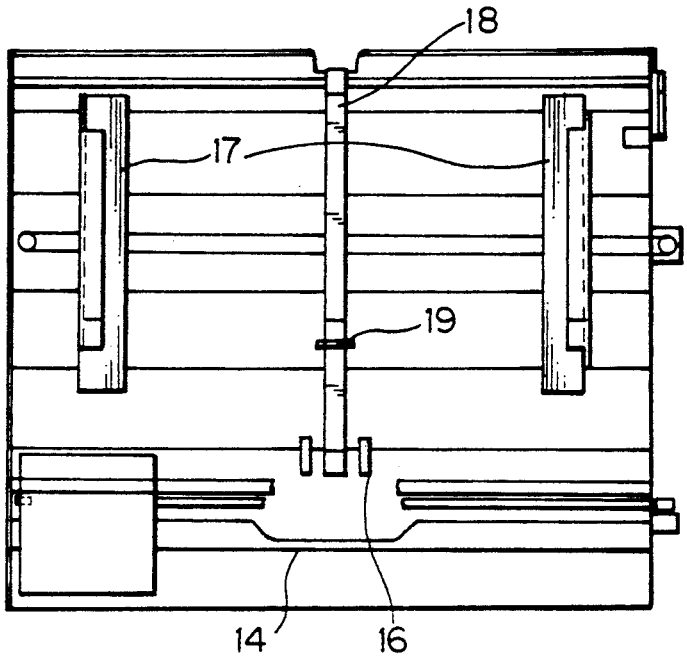
FIG. 2 is a front view of a staple unit included in the finisher.
Figure 3:
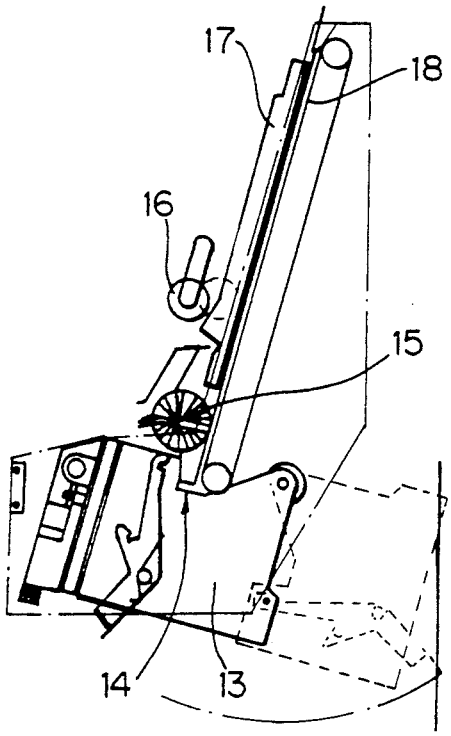
FIG. 3 is a side elevation of the staple unit.

FIGS. 2 and 3 show the staple unit C in detail. Referring to FIGS. 1-3, the staple unit C has a stapler 13 movable in a direction perpendicular to the sheet surface of FIG. 2 in matching relation to a sheet size. The reference numeral 14 designates a guide plate. A brush roller 15 draws the trailing edge of a discharged sheet toward the guide plate 14. A beat roller 16 drives a discharged sheet toward the guide plate 14. A pair of jogger fences 17 position a sheet in a direction perpendicular to an intended direction of sheet transport. A belt 18 discharges a stapled set of sheets to the tray 3. A discharge pawl 19 is affixed to the belt 18. The beat roller 16 is movable to a position indicated by a phantom line in FIG. 3. Specifically, every time a sheet is discharged, the beat roller 16 is moved to the phantom line position and rotated to drive the sheet toward the guide plate 14.

Figure 4:
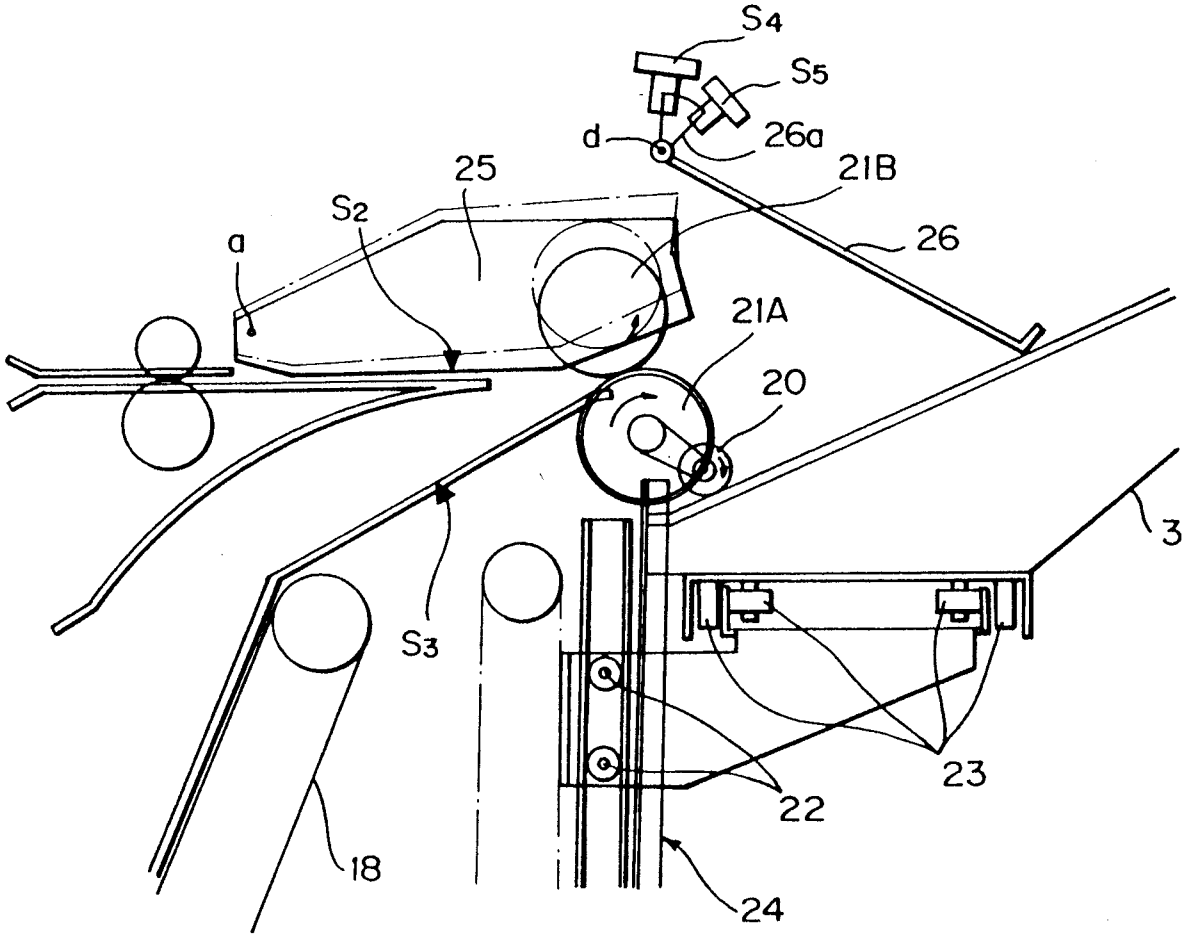
FIG. 4 is a section showing the device embodying the present invention.

Referring to FIG. 4, a section for discharging sheets to the tray 3 includes a discharge roller 21A capable of discharging both of stapled sheets and non-stapled sheets to the tray 3. A positioning roller 20 is disposed in a lower portion of the discharge roller 21A and formed of sponge. A sheet let fall onto the tray 3 is caused to abut against a guide plate 24 by the positioning roller 20 which is in rotation, whereby the trailing edge of the sheet is positioned. The tray 3 is movable up and down through an upper and a lower guide roller 22 and so driven by a drive mechanism which will be described. Further, the tray 3 is movable in a direction perpendicular to the intended direction of sheet discharge through shift guide rollers 23 and also driven by the drive mechanism to be described later. A lever 26 and a sensor S4 cooperate to detect the upper surface of discharged sheets in association with the operation of the positioning roller 20. This allows the level of the tray 3 to be adjusted such that the top of a sheet stack on the tray 3 constantly assumes a predetermined position relative to the discharge roller 21A. A driven roller 21B coacts with the discharge roller 21A and usually remains in contact with the roller 21B. The driven roller 21B is movable about a fulcrum a together with a discharge guide plate 25 to a position indicated by a dash-and-dot line in the figure. Such a movement of the driven roller 21B is effected by a drive mechanism, not shown.

The finisher having the above construction is selectively operable in a sort/stack mode for discharging sheets to the tray 3 one by one without stapling them, and a staple mode for discharging the sheets to the tray 3 after stapling them, as follows.

To begin with, in the sort/stack mode, the path selector 2 is brought to a position indicated by a dashed line in FIG. 1. Hence, the path selector 2 steers sheets sequentially coming out of the image forming apparatus 1 toward the path or stack path A. Then, the sheets are driven out to the tray 3 by the transport rollers 5 and 6. At this instant, the driven roller 21B is constantly pressed against the discharge roller 21A by gravity or by a spring. After the trailing edge of the sheet has moved away from the discharge roller 21A, it is abutted against and positioned by the guide plate 24 due to the rotation of the positioning roller 20. While a predetermined number of sheets are sequentially stacked on the tray 3, the sensor S4 constantly senses the top of the stack. In response to the output of the sensor S4, the tray 3 is moved in the up-and-down direction to maintain the top of the stack at a predetermined level. The tray 3 can be shifted in a direction perpendicular to the direction of sheet discharge so as to sort the sheets, as needed.

In the staple mode, the path selector 2 is held in a position indicated by a solid line in FIG. 1. In this condition, sheets coming out of the apparatus 1 are steered by the path selector 2 to the path or staple path B which extends to the staple unit C. The staple unit C positions the incoming sheets in a predetermined manner and then staples them. The stapled sheets are conveyed toward the discharge roller 21B by the belt 18 extending in a discharge direction b and the rotation of the pawl 19 affixed to the belt 18. At this instant, the driven roller 21B assumes a position indicated by a dash-and-dot line in FIG. 4 and spaced apart from the discharge roller 21A. As a result, the stapled sheets are moved toward the tray 3 via the gap between the rollers 21A and 21B. Before the trailing edge of the stapled sheets moves away from the discharge roller 21A, the driven roller 21B and guide plate 25 are moved toward the roller 21A to a position where the roller 21B presses the sheets. The timing for so moving the driven roller 21B is provided by the output of a sensor S3, FIG. 4. The stapled sheets driven out by the rollers 21A and 21B are abutted against the guide plate 24 by gravity and by the rotation of the positioning roller 20. In this manner, a predetermined number of stapled sets of sheets are sequentially stacked on the tray 3 with their training edges positioned by the guide plate 24. A sensor, FIG. 4, like the sensor S4, constantly senses the top of the stapled sheets to maintain it at a predetermined level.

Figure 5:
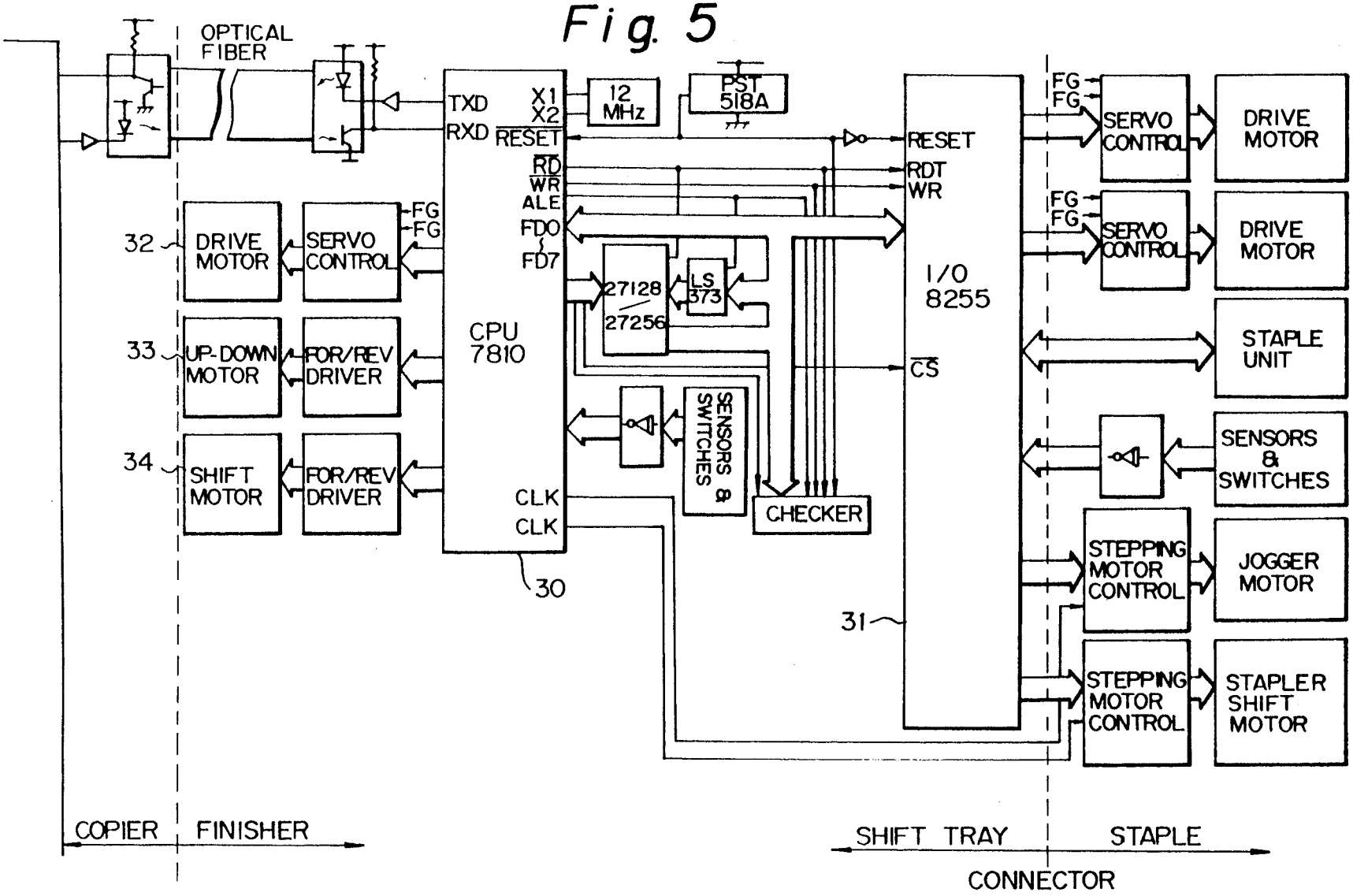
FIG. 5 is a block diagram schematically showing a finisher control system.

FIG. 5 shows a control system associated with the finisher. The following description will concentrate only on the constituents of the system which are related to the present invention. As shown, the control system includes a CPU 30, an I/O port 31 interfacing the CPU 30 and the staple unit C, a motor 32 for driving the roller groups, a tray motor 33 for moving the tray 3 up and down, and a shift motor for moving the tray 3 in the front-and-rear direction.

Figure 6:
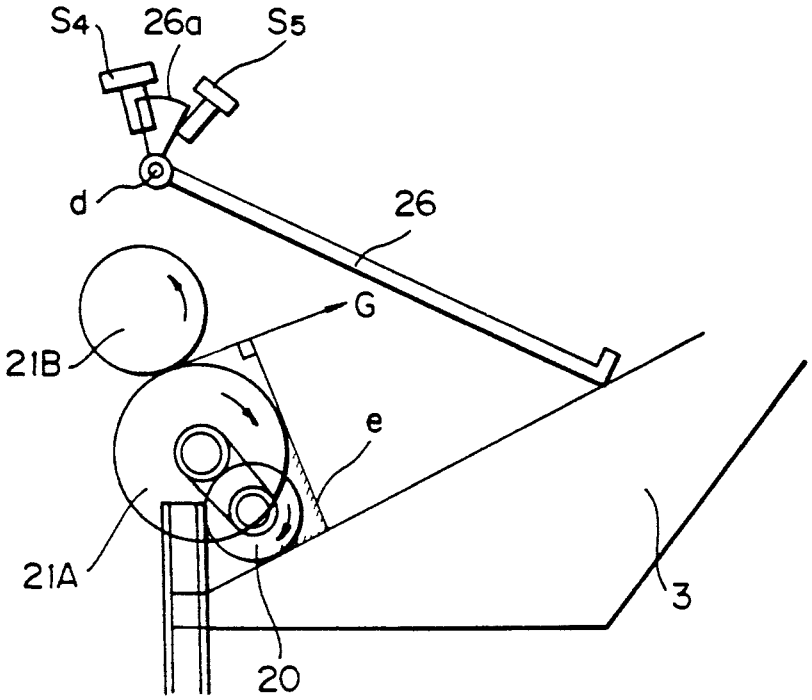
FIG. 6 is a section showing a tray held in a home position in a sort/stack mode.
Figure 7:
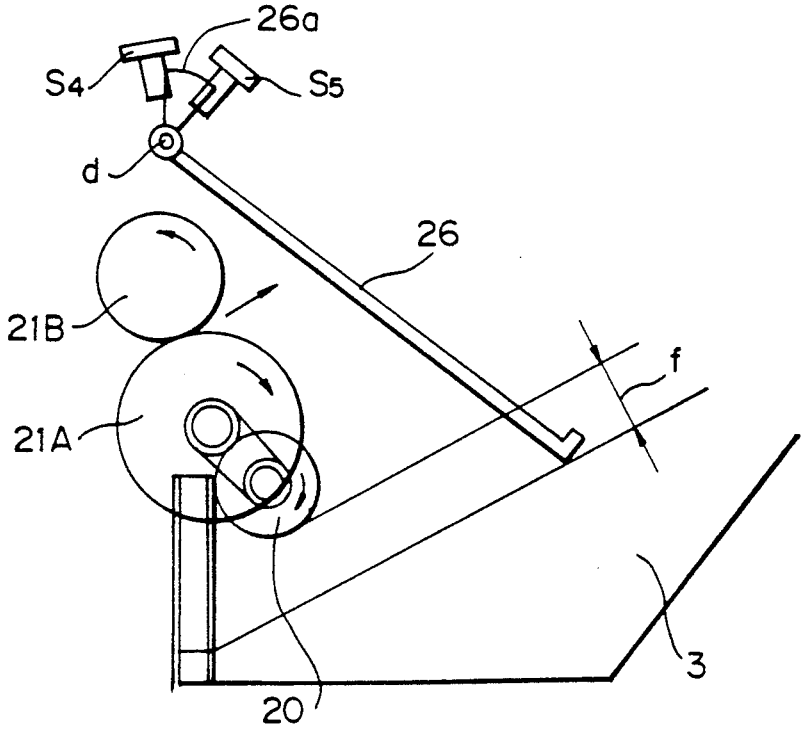
FIG. 7 is a section showing the tray held in a home position in a staple mode.
Figure 8:
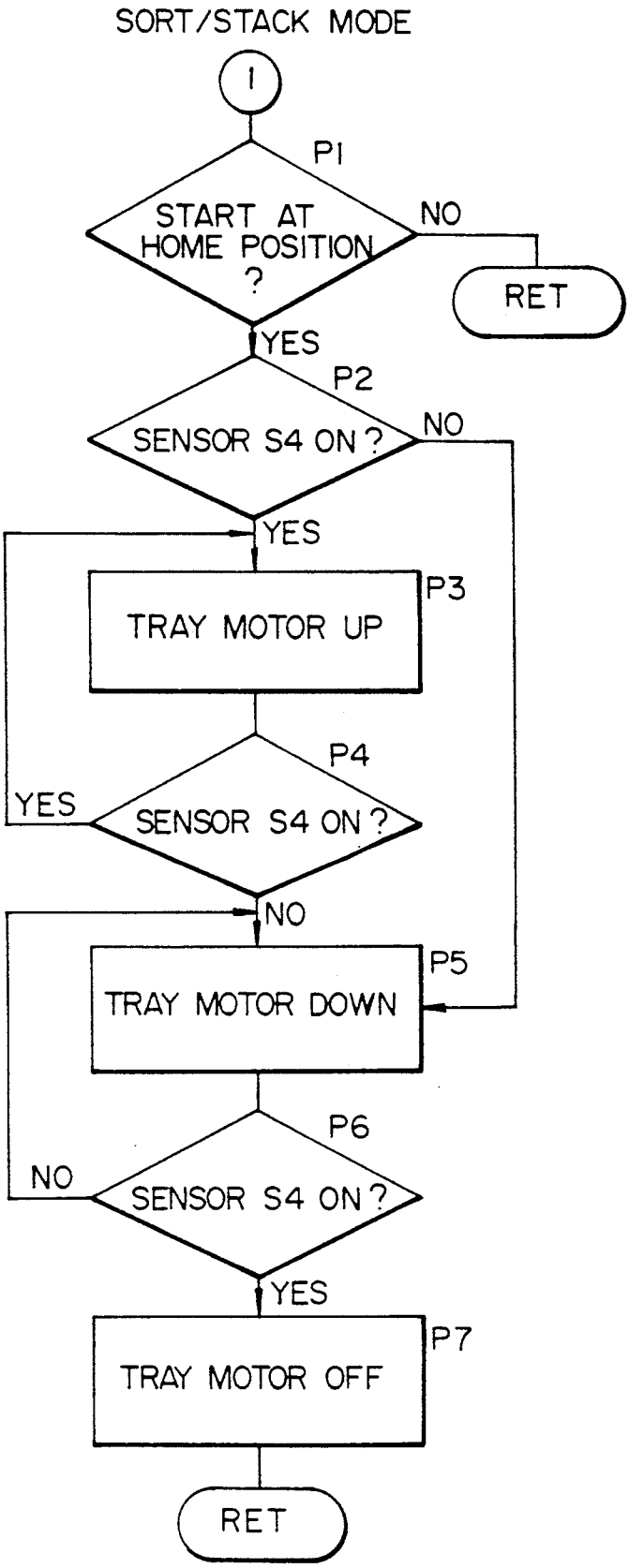
FIG. 8 is a flowchart demonstrating a specific sheet position control procedure to be executed in the sort/-stack mode.
Figure 9:
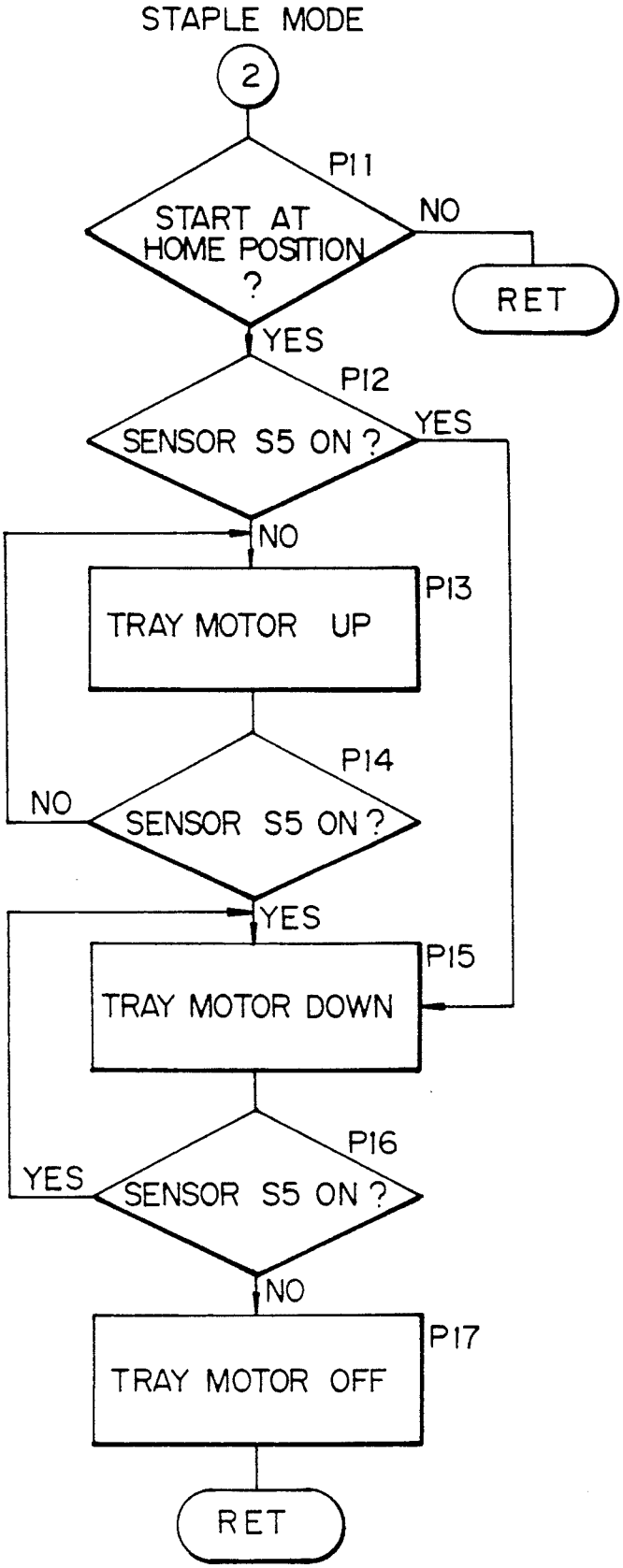
FIG. 9 is a flowchart demonstrating a specific sheet position control procedure to be executed in the staple mode.

FIGS. 6 and 7 show respectively the home position of the tray 3 in the sort/stack mode and the home position of the same in the staple mode. FIGS. 8 and 9 demonstrate sheet position control procedures to be executed in the sort/stack mode and the staple mode, respectively.

The lever 26 senses the top of sheets sequentially stacked on the tray 3 by the rollers 21A and 21B, as stated earlier. In addition, the lever 26 is respective to the home position of the tray 3 when the tray 3 is not loaded with sheets. While the lever 26 is rotated about a fulcrum d, the sensors S4 and S5 sense it. Specifically, the sensors S4 and S5 are respectively a home position sensor assigned to the sort/stack mode and a home position sensor assigned to the staple mode.

The operation of the control system will be described hereinafter.

In the sort/stack mode, the sensor S4 senses the tray 3 located at the home position. In this mode, the home position of the tray 3 is such that it substantially contacts the periphery of the positioning roller 20. That the tray 3 is located at such a home position is determined, as follows.

At the beginning of a copying operation, sheets stacked on the tray 3 are usually removed from the tray 3. Hence, the positioning roller 20 and the tray 3 are spaced apart from each other. At this instant, since the sensor S4 is not screened by a plate 26*a* affixed to the lever 26, the tray 3 is elevated (FIG. 8, steps P1–P3). As soon as the plate 26*a* screens the sensor S4, the elevation of the tray 3 is stopped. Then, the tray 3 is lowered until the plate 26*a* uncovers the sensor S4, i.e., until the tray 3 reaches a home position where it contacts the periphery of the positioning roller 20 (FIG. 8, P4–P7). Also, when sheets are left on the tray 3, the tray 3 is brought to a home position where the top of the sheets contacts the positioning roller 20.

As sheets are sequentially driven out onto the tray 3, the lever 26 rotates an angle matching the increasing number of sheets. As the plate 26*a* of the lever 26 screens the sensor S4, the sensor S4 turns from an ON state to an OFF state. Then, the tray 3 is lowered. As soon as the plate 26*a* again screens the sensor S4, the downward movement of the tray 3 is stopped to maintain the top of the sheets in contact with the positioning roller 20.

The above-described procedure is repeated every time a sheet is drive out onto the tray 3, maintaining the top of such sheets in contact with the positioning roller 20 at all times. As shown in FIG. 6, the periphery of the positioning roller 20 lies in an area e delimited by the tray 3 and a line perpendicular to the direction of sheet discharge G and tangential to the discharge roller 21A. The positioning roller 20, therefore, prevents sheets from irregularly protruding from the stack on the tray 3 (see FIG. 11).

In the staple mode, the home position of the tray 3 is sensed by the sensor S5. In this mode, the home position is such that the tray 3 is spaced apart from the periphery of the positioning roller 20 by a predetermined distance f, FIG. 7. In the illustrative embodiment, the distance f is selected to be 7 millimeters which is greater than the thickness of the maximum number of sheets which can be stapled. The home position of the tray 3 is sensed as follows.

At the beginning of a copying operation, the tray 3 is located at a level lower than the level shown in FIG. 7 since sheets on the tray 3 have been removed then. Since the plate 26*a* of the lever 26 screens the sensor S5, the tray 3 is elevated (FIG. 9, P11–P13). As soon as the plate 26*a* uncovers the sensor S5, the elevation of the tray 3 is stopped. Then, the tray 3 is lowered until the plate 26*a* again screens the sensor S5, i.e., to a home position where the tray 3 is spaced apart from the positioning roller 20 by the distance f (FIG. 9, P14–P17). When sheets are left on the tray 3, the lever 26 also detects the top of the sheets and causes it to be spaced apart from the positioning roller 20 by the distance f.

When stapled sheets are sequentially driven out onto the tray 3, the lever 26 rotates an angle matching the increasing number of sheets. As the plate 26*a* screens the sensor S5, the sensor S5 turns from an OFF state to an ON state. Then, the tray 3 is lowered. As the sensor S5 regains the OFF state due to the movement of the tray 3, the tray 3 is again brought to a stop. As a result, the top of the stapled sheets on the tray 3 is constantly spaced apart from the positioning roller 20 by the distance f.

The above procedure is repeated every time a stapled set of sheets is laid on the tray 3 so as to maintain the distance f between the top of the sheets and the positioning roller 20. Therefore, the stapled sheets are smoothly stacked on the tray 3 without the positioning roller 20 interfering with them.

In summary, in accordance with the present invention, a tray is provided with a particular home position in each of a sort/stack mode and a staple mode. The home position in the sort/stack mode is such that the tray contacts a positioning roller, while the home position in the staple mode is such that it is spaced apart from the positioning roller. This is successful in insuring a neat stack in the sort/stack mode and in preventing sheets from being turned over or ripped off by the positioning roller in the staple mode. In the home position in the staple mode, the tray is spaced apart from the positioning roller by a distance greater than the thickness of the maximum number of sheets which can be stapled. This also frees the stapled sheets from the interference of the positioning roller. Further, since the periphery of the positioning roller is located at the rear of a line perpendicular to a direction of sheet discharge and tangential to the periphery of a discharge roller, the positioning roller does not interfere with the trailing edge of a sheet; otherwise it would cause the above-mentioned occurrences.

Various modifications will become possible for those skilled in the art after receiving the teachings of the present disclosure without departing from the scope thereof.

What is claimed is:

1. A sheet stacking device for an image forming apparatus, comprising:

discharge roller means for discharging a sheet driven out of the image forming apparatus;

tray means for stacking the sheets sequentially discharged by said discharge roller means;

rotatable positioning roller means facing the top of the sheets stacked on said tray means;

sensing means for sensing a level of uppermost one of the sheets stacked on said tray means;

tray moving means for adjusting the level of the uppermost one of the sheets in response to an output of said sensing means; and control means for locating, when non-stapled sheets are discharged one by one, said tray means at a home position where said tray means contacts said positioning roller means or locating, when stapled sheets are discharged, said tray means at a home position where said tray means is spaced apart from said positioning roller means.

2. A device as claimed in claim 1, wherein in said home position when stapled sheets are discharged, said tray means and said positioning roller means are spaced apart by a distance greater than a thickness of a maximum number of sheets which can be stapled.

3. A device as claimed in claim 1, wherein periphery of said positioning roller means is located at the rear of a line perpendicular to an intended direction of sheet discharge and tangential to periphery of said discharge roller means in an intended direction of sheet discharge.

* * * * *